United States Patent [19]

Goldberger et al.

[11] Patent Number: 4,932,803

[45] Date of Patent: Jun. 12, 1990

[54] STICK DISPENSER

[75] Inventors: Harry M. Goldberger, Edison; Michael E. Radice, Colts Neck, both of N.J.

[73] Assignee: Revlon, Inc., New York, N.Y.

[21] Appl. No.: 260,763

[22] Filed: Oct. 21, 1988

[51] Int. Cl.[5] ..... A45D 40/04

[52] U.S. Cl. ..... 401/75; 401/175; 222/390

[58] Field of Search ..... 401/73, 75, 116, 49, 401/175, 55, 68; 222/389, 390

[56] References Cited

U.S. PATENT DOCUMENTS

| | | | |
|---|---|---|---|
| 4,298,036 | 11/1981 | Horvath | 401/49 |
| 4,369,158 | 1/1983 | Woodruff | 401/175 |
| 4,545,696 | 10/1985 | Carluccio | 401/175 |
| 4,605,330 | 8/1986 | Crowley | 401/175 |
| 4,664,547 | 5/1987 | Rosenwinkel | 401/175 |
| 4,702,399 | 10/1987 | Davis | 401/175 |

*Primary Examiner*—Richard J. Johnson

[57] ABSTRACT

A dispenser employs a container adapted for bottom-filling with a molten material which solidifies on an elevator cup to form a stick-type product. The elevator cup is moved up and down within the container by a lifting mechanism which extends through an opening in an otherwise closed end of the container. The elevator cup is provided with a sealing assembly designed to seal the opening in the closed end of the container when the elevator cup is in a retracted position, which it assumes during the filling operation and in which it preferably remains until the initial use of the dispenser.

5 Claims, 2 Drawing Sheets

STICK DISPENSER

FIELD OF THE INVENTION

The present invention relates to dispensers useful for the packaging and application of products such as cosmetics, deodorants, antiperspirants, and the like. Such products are typically gelled or wax-like mixtures of components including one or more active ingredients in a vehicle which forms a solid at room temperature, but which can be melted at elevated temperatures so as to form a thin film on the skin of a user.

BACKGROUND OF THE INVENTION

The practice of providing stick-type products has heretofore presented various problems involving the type of dispenser to be used in connection therewith. In accordance with one conventional approach, the dispenser includes an upstanding vertical wall, a closed bottom, and an open mouth. A support plate within the dispenser is dimensioned for close fit with the interior surface of the dispenser, which can be any shape, such as circular or elliptical. The dispenser is further fitted with means for moving the support plate along the axis of the dispenser to any desired position within the dispenser. Such moving means typically comprises a threaded rod centrally located within the dispenser, the rod being attached to a knurled knob outside the dispenser in a manner such that the knob and rod can be rotated about their common axis but cannot move along that axis. The support plate is provided with a threaded hole which threadedly receives the rod in such a manner that rotation of the knob raises or lowers the plate as the user desires. This type of dispenser is filled by assembling the dispenser, the knob and rod assembly, and the plate, with the plate at its lowermost position within the dispenser, and the product to be dispensed is then poured into the open mouth of the dispenser in its molten state so as to fill the dispenser. In view of the close fit between the plate and the inside surface of the dispenser, the dispenser is filled from the surface of the plate to the top of the dispenser. When the dispenser is filled in this way, as the molten product cools, its upper surface takes on a concave shape. This is relatively unsightly, wastes space at the top of the dispenser, and is uncomfortable to the user upon the first application from a fresh stick as the edge of the solidified product forms a relatively sharp corner which can be uncomfortable to the user's skin. One expedient for resolving this problem is to reheat and cool the top of the solidified product repeatedly, but besides being cumbersome and expensive this expedient can lead to a loss of homogeneity of the product.

In accordance with an alternate method, the knob and rod assembly is removed prior to the commencement of the filling operation, leaving an opening in the otherwise closed bottom of the dispenser. With the dispenser inverted (i.e., with its bottom end up), the filling operation is carried out through the opening in the bottom of the dispenser. At the completion of the filling operation, the rod of the knob and rod assembly would be inserted into the dispenser through the opening in the bottom thereof. One disadvantage of this method is that an 0-ring or some equivalent type of sealing member must be employed in order to seal the opening in the bottom of the dispenser.

Another alternative for providing stick-type products is to form a dispenser in which the bottom as well as the mouth are open. Then, a dome or cap is placed on the open mouth of the dispenser, and the dispenser is inverted and filled through its open bottom. The bottom is then closed by insertion of an appropriate mechanism capable of sealing the bottom and of lifting the solidified product out of the mouth of the dispenser. This type of dispenser is undesirable because it requires the utilization of a special lifting mechanism which can be relatively expensive and it creates the potential for weight loss of volitile products due to the difficulty of creating a seal.

SUMMARY OF THE INVENTION

The problems and disadvantages discussed above are overcome in accordance with one aspect of the present invention by providing a dispenser for a stick-type product with a container having at least one fill hole, or some other equivalent means, provided in a closed end of the container and adapted to receive a discharge nozzle of a filling machine designed to supply the product, in molten form, to an interior chamber of the container while the container is maintained in an inverted position. By providing passageways in a product support member, which is moveably supported within the interior chamber in such a manner that the chamber is divided into a pair of adjacent sections, the molten product can pass through the support member as it flows from one section of the chamber to the other section of the chamber, where it eventually collects and solidifies. The solidified product, which is now supported solely by the support member, can be moved within the container between a retracted position and an extended position by a lifting mechanism which extends into the interior chamber of the container through an opening in closed end thereof.

In accordance with another aspect of the present invention, the support member carries a sealing assembly which seals the opening in the closed end of the container when the support member is in its retracted position. As long as the support member does not move from its retracted position, outside air is prevented from entering the interior chamber of the container through the opening in the closed end thereof. Thus, the solidified product remains hermetically sealed until the initial application of the product by a user.

BRIEF DESCRIPTION OF THE DRAWINGS

For a better understanding of the present invention, reference is made to the following detailed description of an exemplary embodiment considered in conjunction with the accompanying drawings, in which.

DESCRIPTION OF THE EXEMPLARY EMBODIMENT

Figure 1:
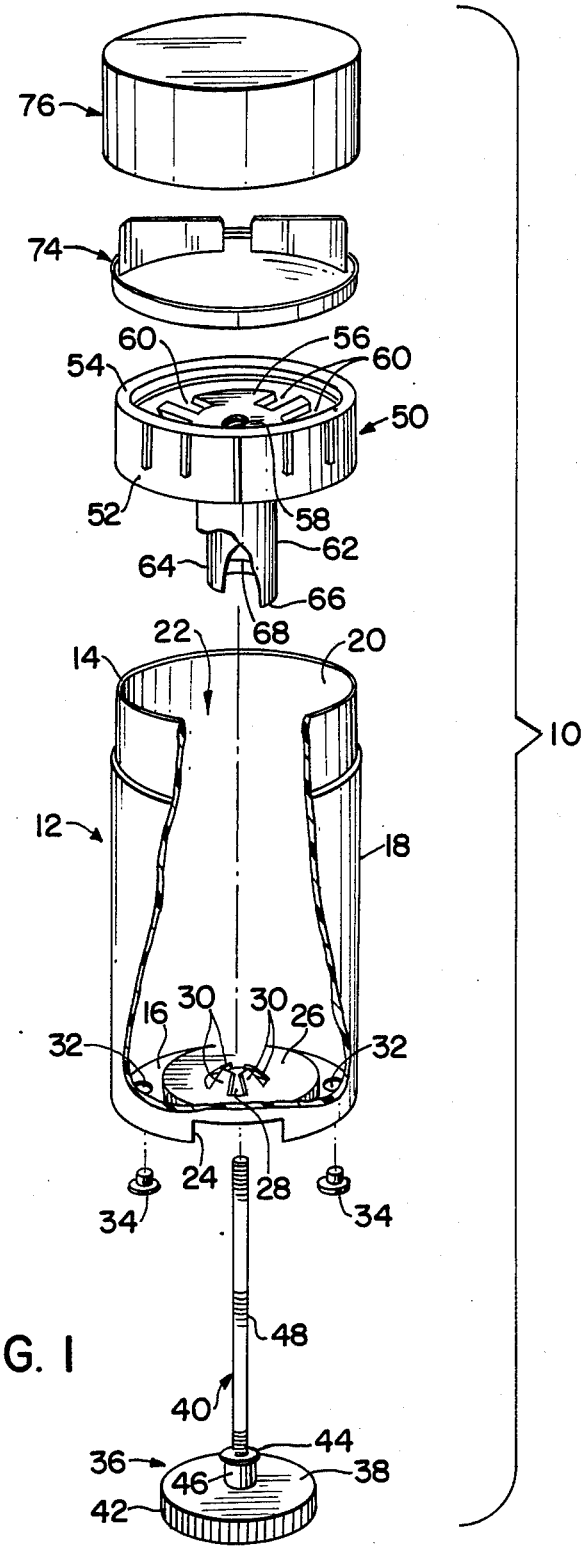
FIG. 1 is an exploded perspective view of a stick dispenser constructed in accordance with one exemplary embodiment of the present invention, portions of the dispenser being broken away to facilitate consideration and discussion.

Referring, for the most part, to FIG. 1, a stick dispenser 10 includes a container 12 having an open end 14 and a substantially closed end 16, which is formed monolithically or in an otherwise integral manner with the container 12. The container 12 also includes a sidewall 18 having a generally elliptical cross-sectional shape. The sidewall 18 has a smooth inner surface 20, which defines an interior chamber 22, and cutouts 24 (only one of which is visible in FIG. 1), whose function will become apparent from the following discussion.

The closed end 16 of the container 12 is provided with a platform 26, which includes a centrally located opening 28. Mounting fingers 30, each of which extends upwardly from the platform 26 at an incline angle relative to the horizontal, ring the opening 28. The fingers 30 are deflectable for a reason which will be described hereinafter.

The closed end 16 of the container 12 also includes a pair of fill holes 32, one on either side of the platform 26. Each of the fill holes 32, whose function will be described in greater detail below, is adapted to receive a plug 34. The number of the fill holes 32 and the plugs 34 employed by the container 12 can be varied as desired. The only requirement is that at least one of the fill holes 32 be utilized along with at least one of the plugs 34.

A knob 36 includes a disk 38 and a spindle 40. The disk 38 has a skirt 42 which is knurled so as to facilitate gripping between the thumb and index finger of a user. A circular flange 44 extends radially outwardly from the spindle 40, dividing the spindle 40 into a non-threaded portion 46 and an externally threaded portion 48.

In order to attach the knob 36 to the container 12, the spindle 40 is inserted through the opening 28 until the flange 44 rests on the fingers 30 and the externally threaded portion 48 extends into the interior chamber 22. The insertion of the spindle 40 is facilitated by the deflectability of the fingers 30, which can be deflected far enough to allow the passage of the flange 44. The elastic memory of the fingers 30 causes them to return to their original undeflected position after the passage of the flange 44 In their undeflected position, the fingers 30 cradle the flange 44 of the spindle 40 in such a manner that the knob 36 can be readily rotated by a user, who would grip the portions of the knurled skirt 42 exposed by the cutouts 24 and then rotate the disk 38. The reason for rotating the knob 36 will be described hereinafter.

An elevator cup 50 is positioned within the interior chamber 22 of the container 12 such that the elevator cup 50 can be moved up and down inside the container 12. The elevator cup 50 includes a body 52, which is provided with an outwardly extending lip 54 adapted to be maintained in sliding, yet sealing, engagement with the inner surface 20 of the container 12 as the elevator cup 50 moves relative to the container 12. The elevator cup 50 also includes a base 56 having an internally threaded bore 58 adapted to threadedly receive the externally threaded portion 48 of the spindle 40, whereby the rotation of the knob 36 in one direction results in a lifting (i.e., extension) of the elevator cup 50 and the rotation of the knob 36 in an opposite direction results in a lowering (i.e., retraction) of the elevator cup 50. Passageways 60 are also provided in the base 56 for a purpose to be described hereinafter.

Figure 2:
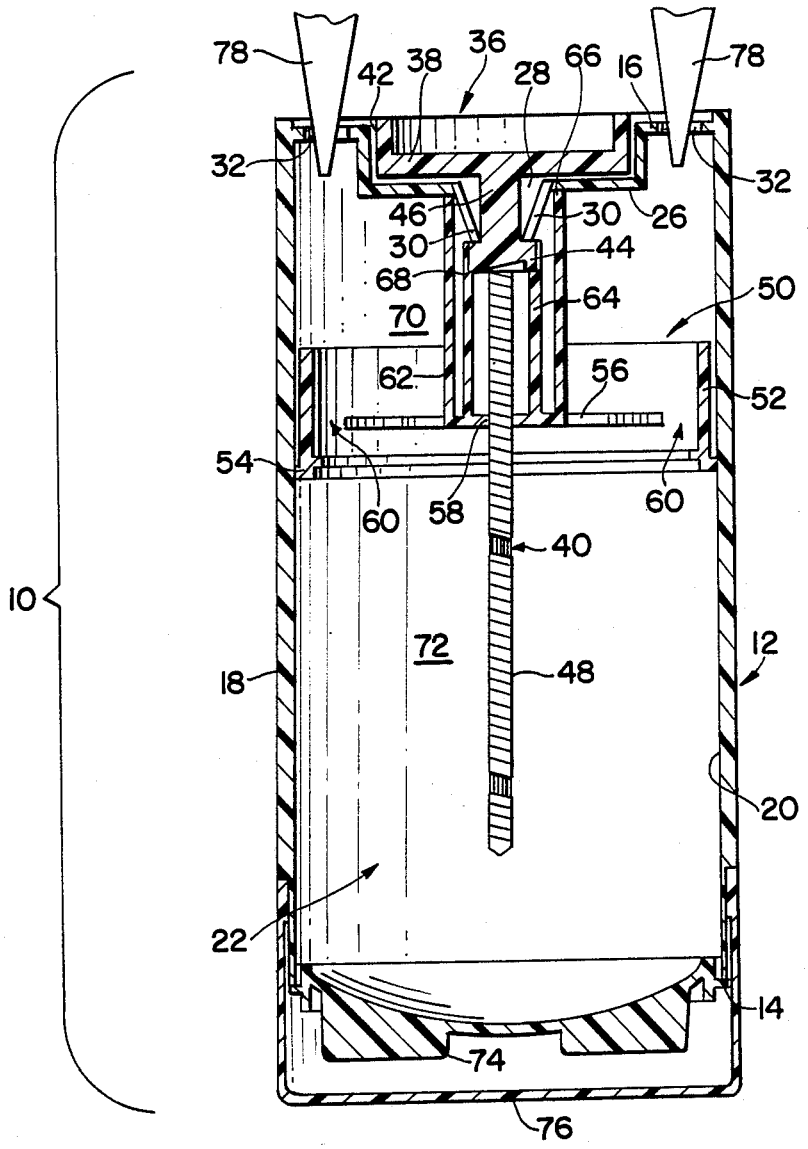
FIG. 2 is a cross-sectional view of the stick dispenser of FIG. 1 during a filling operation.

An outer sleeve 62 depends from the base 56 of the elevator cup 50. An inner sleeve 64, which is arranged coaxially relative to the outer sleeve 62, also depends from the base 56. The outer sleeve 62 has a lower end 66 which contacts the platform 26 and covers the opening 28 when the elevator cup 50 is in its lowermost (i.e., retracted) position, thereby forming a first seal. The inner sleeve 64 is provided with a seat 68, which receives the flange 44 of the spindle 40 when the elevator cup 50 is in its retracted position, thereby forming a second seal which cooperates with the first seal to prevent outside air from entering the interior chamber 22 of the container 12 through the opening 28. When the elevator cup 50 is in its retracted position, or any other position for that matter, it effectively divides the interior chamber 22 into sections 70, 72 (see FIG. 2).

A dome 74 is removably applied to the open end 14 of the container 12. The main purpose of the dome 74 is to give an exposed tip of a stick-type product (not shown) a convex (i.e., rounded) shape, thereby making the initial application of the product more comfortable to a user. In addition, the dome 74 protects the contents of the container 12 prior to its initial use. If the contents is a volatile substance, such as a deodorant product, then the dome 74 will also function to inhibit its evaporation. The dome 74 is normally removed and discarded after the initial use of the dispenser 10.

A removable cap 76 fits over the open end 14 of the container 12, including the dome 74. Like the dome 74, the cap 76 functions to protect the contents of the container 12 and to inhibit its evaporation. However, unlike the dome 74, the cap 76 is not discarded after the initial use of the dispenser 10.

At the commencement of a filling operation, the container 12, in its fully assembled state except for the removal of the plugs 34, is turned upside down while the elevator cup 50 is maintained in its retracted position. Dispensing nozzles 78 are inserted through the fill holes 32 for the purpose of delivering a desired product to the section 70 of the interior chamber 22 in molten form. The molten product flows freely into the section 72 of the interior chamber 22 through the passageways 60 provided in the base 56 of the elevator cup 50. During such a dispensing operation, the clearance fit existing between the dispensing nozzles 78 and the fill holes 32 permits air to be evacuated from the interior chamber 22 of the container 12. Alternatively, one of the fill holes 32 can be used for filling purposes, while the other of the fill holes 32 is used for venting purposes.

When enough of the molten product has been dispensed to fill the section 72 of the interior chamber 22, the dispensing operation is automatically terminated. The nozzles 78 are then withdrawn from the fill holes 32 so that the fill holes 32 can be permanently sealed by the plugs 34. After allowing the product to sufficiently cool and solidify, the container 12 can be turned right side up. As long as the dome 74 and the cap 76 are in place and the elevator cup 50 is in its retracted position, the container 12 is, for all intents and purposes, hermetically sealed.

In use, the dome 74 and the cap 76 are removed from the open end 14 of the container 12 to expose the product, the exposed tip of which, as indicated above, has a convex shape as a result of the use of the dome 74 in connection with the foregoing filling operation. If it is not desired to provide the exposed tip of the product with a convex shape, then the dome 74 could be replaced by a thin barrier sheet, such as a piece of flexible vinyl provided with pressure-sensitive adhesive for the purpose of releasably attaching the barrier sheet to the open end 14 of the container 12. Regardless of the ultimate shape of its exposed tip, as the product is used up, the knob 36 can be rotated in an appropriate direction to cause the elevator cup 50 to move from its retracted position toward the open end 14 of the container 12, thereby exposing additional product for application to the skin of the user.

It will be understood that the embodiment described herein is merely exemplary and that a person skilled in the art may make many variations and modifications without departing from the spirit and scope of the invention. All such modifications are intended to be included within the scope of the invention as defined in the appended claims.

We claim:

1. A dispenser for a product which is provided in the form of a stick, comprising a container having an interior chamber, an open end and a substantially closed end opposite said open end, said closed end including an opening extending therethrough and communicating with said interior chamber; supporting means for supporting a product stick within said interior chamber of said container, said supporting means being non-rotatably mounted within said interior chamber of said container but being movable within said interior chamber from a retracted position, in which said supporting means is proximate to said closed end of said container, to an extended position, in which said supporting means is proximate to said open end of said container, and said supporting means including an internally threaded bore and extending across said interior chamber of said container so as to divide said interior chamber into a first section located between said supporting means and said closed end of said container and a second section located between said supporting means and said open end of said container; moving means extending through said opening in said closed end of said container for moving said supporting means from its said retracted position to its said extended position, said moving means including a knob rotatably mounted externally of said container adjacent to said closed end thereof, said knob including a spindle extending into said interior chamber of said container through said opening in said closed end of said container, said spindle having a flange located within said interior chamber of said container in the vicinity of said closed end of said container and extending radially outwardly from said spindle and an externally threaded portion on a side of said flange opposite from said closed end of said container, said externally threaded portion being threadedly received in said internally threaded bore of said supporting means such that said supporting means moves from its said retracted position toward its said extended position in response to the rotation of said spindle; receiving means provided in said closed end of said container for receiving at least one discharge nozzle of a filling machine adapted to supply the product to said first section of said interior chamber in molten form, said receiving means including at least one fill hole extending through said closed end of said container; connecting means for connecting said first section of said interior chamber to said second section of said interior chamber, whereby the molten product can flow from said first section of said interior chamber to said second section of said interior chamber, said connecting means including at least one passageway extending through said supporting means; and sealing means attached to said supporting means for sealing said opening in said closed end of said container when said supporting means is in its said retracted position, said sealing means including an outer sleeve which extends from said supporting means and surrounds said spindle, said outer sleeve contacting said closed end of said container when said supporting means is in its said retracted position and encircling said opening in said closed end so as to form a first seal when said supporting means is in its said retracted position, and an inner sleeve which extends from said supporting means and surrounds said spindle, said inner sleeve contacting said flange of said spindle when said supporting means is its said retracted position so as to form a second seal when said supporting means is in its said retracted position.

2. A dispenser according to claim 1, wherein said first and second seals cooperate to prevent outside air from entering said interior chamber through said opening when said supporting means is in its said retracted position.

3. A dispenser according to claim 2, further comprising mounting means for mounting said spindle within said interior chamber of said housing, said mounting means including a plurality of resilient fingers extending into said interior chamber from said closed end of said container, said fingers being arranged in spaced-apart relationship around a peripheral edge of said opening, and each of said fingers extending toward said spindle at an inclined angle relative to said closed end of said container.

4. A dispenser according to claim 3, wherein said fingers are resilient enough to deflect a distance sufficient to permit the passage of said flange of said spindle as said spindle is inserted into said interior chamber of said container, said fingers having an elastic memory sufficient to cause them to automatically return to a substantially undeflected position after the passage of said flange of said spindle.

5. A dispenser according to claim 4, wherein said outer sleeve encircles said fingers when said supporting means is in its said retracted position.

* * * * *